US005275336A

United States Patent [19]

Stasi et al.

[11] Patent Number: 5,275,336

[45] Date of Patent: Jan. 4, 1994

[54] WIRE THERMAL SPRAY GUN AND METHOD

[75] Inventors: Robert J. Stasi, Hicksville; Peter J. Ribando, Mt. Sinai; James J. Savino, Ridge, all of N.Y.

[73] Assignee: The Perkin-Elmer Corporation, Norwalk, Conn.

[21] Appl. No.: 802,109

[22] Filed: Dec. 4, 1991

[51] Int. Cl.[5] ..... B05B 7/18; B05B 7/20; B05B 1/28

[52] U.S. Cl. ..... 239/84; 239/290

[58] Field of Search ..... 239/83, 84, 290, 526

[56] References Cited

U.S. PATENT DOCUMENTS

| | | | |
|---|---|---|---|
| 1,725,012 | 8/1929 | Meurer | 239/84 X |
| 2,150,949 | 3/1939 | Stevens . | |
| 2,227,753 | 1/1941 | Ingham | 239/84 |
| 2,556,193 | 6/1951 | Kenshol | 239/84 |
| 2,769,663 | 11/1956 | Jensen et al. | 239/84 |
| 2,960,274 | 11/1960 | Shepard . | |
| 2,961,335 | 11/1960 | Shepard . | |
| 2,982,480 | 5/1961 | Gilliland et al. | 239/84 |
| 3,013,528 | 12/1961 | Bland | 239/84 X |
| 3,056,558 | 10/1962 | Gilliland . | |
| 3,085,750 | 4/1963 | Kenshol . | |
| 3,122,321 | 2/1964 | Wilson et al. . | |
| 3,136,484 | 6/1964 | Ditrich . | |
| 3,148,818 | 9/1964 | Charlop . | |
| 3,378,203 | 4/1968 | Stanton . | |
| 3,546,415 | 12/1970 | Marantz . | |
| 3,901,441 | 8/1975 | Kasagi | 239/84 X |
| 4,512,513 | 4/1985 | Rogers | 239/83 X |
| 4,613,062 | 9/1986 | Walter et al. | 222/146.2 |
| 5,014,916 | 5/1991 | Trapani et al. | 239/85 |

FOREIGN PATENT DOCUMENTS

| | | | |
|---|---|---|---|
| 162626 | 3/1949 | Austria | 239/83 |
| 1912476 | 10/1970 | Fed. Rep. of Germany . | |
| 42562 | 3/1926 | Norway | 239/83 |
| 685422 | 5/1953 | United Kingdom . | |
| 1099985 | 1/1968 | United Kingdom . | |
| 9112183 | 8/1991 | World Int. Prop. O. | 239/83 |

*Primary Examiner*—Andres Kashnikow
*Assistant Examiner*—William Grant
*Attorney, Agent, or Firm*—H. S. Ingham; E. T. Grimes; J. R. Wahl

[57] ABSTRACT

In an angular gas cap on a wire thermal spray gun, a forward channel extends from a rearward channel at an oblique angle thereto so as to have a lateral directional component. The rearward channel at the nozzle has a channel axis parallel to the central axis of the nozzle and is offset from the central axis in a direction opposite the lateral directional component. Immediately upon termination of spraying the wire is retracted into the nozzle. A wire positioner includes a hollow collet with the wire extending therethrough. A linear actuator retains the collet against a wall to hold the collet open from the wire during spraying. Upon termination of spraying the actuator retracts to release the collet from the wall so the collet is sprung to engage the wire during the retraction. Upon startup the wire is advanced into the gas cap faster than normal spraying speed.

38 Claims, 4 Drawing Sheets

| FIG.2a | FIG.2b |
|---|---|

WIRE THERMAL SPRAY GUN AND METHOD

This invention relates to thermal spraying and particularly to a thermal spray gun and method for spraying at an oblique angle.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A thermal spray gun is used for the purpose of both heating and propelling the particles.

In one type of such gun (e.g. U.S. Pat. No. 2,961,335, Shepard) the material is fed into a heating zone in the form of a heat fusible powder, generally in a size between about 5 and 150 microns. In another type a rod or wire is fed such as described in U.S. Pat. No. 3,148,818 (Charlop). The heating zone is formed by a flame of some type, such as a combustion flame where it is melted or at least heat-softened. A melted wire tip is atomized by an atomizing blast gas such as compressed air, and thence propelled in finely divided form onto the surface to be coated. The spray head includes a nozzle and a gas cap for providing an annular flame around an axially fed spray material.

Ordinarily a thermal spray gun has a spray head including the nozzle and gas cap mounted directly on a gun body for spraying in a forward direction, for example for coating a flat or external cylindrical surface. However, some applications involve spraying into restricted areas such as the inside of bore holes, for example cylinder bores of pumps or combustion engines. In such cases it is necessary to use an extension for the spray head adapted to deflect or otherwise direct the spray stream transversely so as to coat a side wall. Examples of extensions for wire thermal spray guns are disclosed in U.S. Pat. Nos. 3,122,321 (Wilson), 3,136,484 (Dittrich), 3,056,558 (Gilliland et al) and 3,085,750 (Kenshol). It may be seen that there are several basic types: one uses a blast gas for deflecting the spray stream, another has an angular gas cap to deflect the spray, and yet another combines these two.

In some circumstances there is a tendency for spray material from the wire tip to build up inside of the gas cap and/or on the nozzle face. This can occur in an ordinary straight-spraying gun, but particularly may occur with an extension in which the spray stream is deflected by an angular gas cap, as there is more enclosure of the spray in the gas cap. Also, the typically constricted spray region in a bore hole raises the temperature of the spray head, encouraging adhesion, and causes back deflection of spray particles.

A specific material with a buildup problem in the nozzle is molybdenum spray wire, with which oxidation has caused jamming in the nozzle, a condition to which U.S. Pat. No. 2,960,274 (Shepard) is directed by providing a wire guide insert in the nozzle. Buildup is also associated with starting and stopping of spraying, as in repetitive operations. A bulge or "mushroom" may develop on the wire tip under ordinary stopping conditions, which may jam or spit off and stick to the gas cap upon subsequent startup.

As generally shown in the aforementioned patents, a spray wire is driven by an electric motor or air-driven turbine. Further details of mechanisms including drive rolls for gripping and feeding the wire are illustrated in the aforementioned U.S. Pat. No. 3,148,818. As also pointed out in U.S. Pat. Nos. 2,150,949 (Stevens) and 3,378,203 (Stanton), the conventional practice is to coordinate starting and stopping of wire feed with simultaneous changing of gas flows.

SUMMARY OF THE INVENTION

Objects of the present invention include the providing of a novel angular gas cap for coupling over a nozzle of a thermal spray gun, and an improved process for using an angular gas cap, particularly to reduce or eliminate buildup of spray material in the gas cap or on the nozzle face. Another object is to provide an improved thermal spray apparatus incorporating such a gas cap. Further objects are to provide a novel apparatus and process for retracting a thermal spray wire upon stopping of wire feeding so as to further minimize buildup particularly with an angular gas cap, and more particularly with the angular gas cap of the invention.

The foregoing and other objects are achieved with an angular gas cap for coupling over a nozzle of a thermal spray gun, preferably a wire type of gun. The angular gas cap has a passage therethrough including a forward channel with an open end and a rearward channel adapted to extend from the nozzle. The forward channel extends from the rearward channel at an oblique angle thereto so as to have a lateral directional component. The rearward channel has a channel axis that is parallel to the central axis of the nozzle and is offset from the central axis in a direction opposite the lateral directional component.

The objects are further achieved with a positioning means disposed on a thermal spray gun for transitorily retracting the wire rearwardly immediately upon termination of feeding the wire. The wire tip should be retracted into the nozzle sufficiently fast upon termination of feeding the wire to prevent significant mushrooming of the wire tip. The retracting means is advantageously utilized with an angular gas cap, and preferably with the angular gas cap of the invention. The positioning means also advantageously includes advancing means for momentarily advancing the wire forwardly from the nozzle into the gas cap at a rapid speed greater than normal wire speed, upon startup of spraying.

In a preferred embodiment the positioning means comprises a guide means, a linear actuator and a chuck assembly. The guide means is connected to the gun in alignment therewith for guiding a spray wire into the gun. The guide means includes a rearwardly facing guide wall with an orifice therein for the wire. The linear actuator is connected to the gun and has an actuating motion substantially parallel to the center axis.

The chuck assembly is attached to the linear actuator so as to be longitudinally positionable by the actuating motion. The assembly comprises a collet chuck, a collet disposed in the chuck so as to protrude from the chuck toward the guide wall, and a spring means for urging the collet forwardly in the chuck so as to normally engage the wire. The linear actuator is selectively controlled to a first position or a second position. The first position is such that the collet is urged against the guide wall so that the collet is disengaged from the wire, and the second position is such that the chuck assembly is retracted away from rear wall so that the spring means causes the collet to engage the wire. Thus, with the linear actuator in the first position the wire is free to feed through the gun, and during a transition to the second position the wire is engaged by the collet and retracted thereby.

The objects are also achieved by a method for thermal spraying with a thermal spray gun, the gun including a gun body, a nozzle mounted on the gun body, and an angular gas cap extending forwardly from the nozzle. The gas cap has a passage therethrough defining a combination chamber. The passage includes a forward channel with an open end and a rearward channel to extending from the nozzle on a channel axis. The forward channel extends from the rearward channel at an oblique angle thereto so as to have a lateral directional component. The method comprises effecting an annular flame from the nozzle in the combustion chamber feeding a wire forwardly through the nozzle on a central axis parallel to the channel axis and offset therefrom in a direction coinciding with the lateral directional component such that the wire has a tip melted by the annular flame, and providing pressurized gas into the angular gas cap for atomizing the melted tip into a spray stream that is propelled generally at the oblique angle.

The method preferably further comprises stopping the feeding of the wire and retracting the wire rearwardly into the nozzle immediately upon stopping feeding. The retracting should be effected sufficiently fast to prevent significant mushrooming of the wire tip. The method also includes momentarily advancing the wire forwardly from the nozzle into the gas cap at a rapid speed greater than normal wire speed, upon startup of spraying.

Objects also achieved by a method for thermal spraying with a thermal spray gun including a gun body, a nozzle mounted on the gun body, and a gas cap mounted over the nozzle. The method comprises thermal spraying normally, and then subsequently terminating the thermal spraying by stopping feeding of the wire and retracting the wire rearwardly into the nozzle immediately upon stopping feeding. The method is advantageously effected with an angular gas cap, preferably of the present invention.

DETAILED DESCRIPTION OF THE INVENTION

Figure 1:
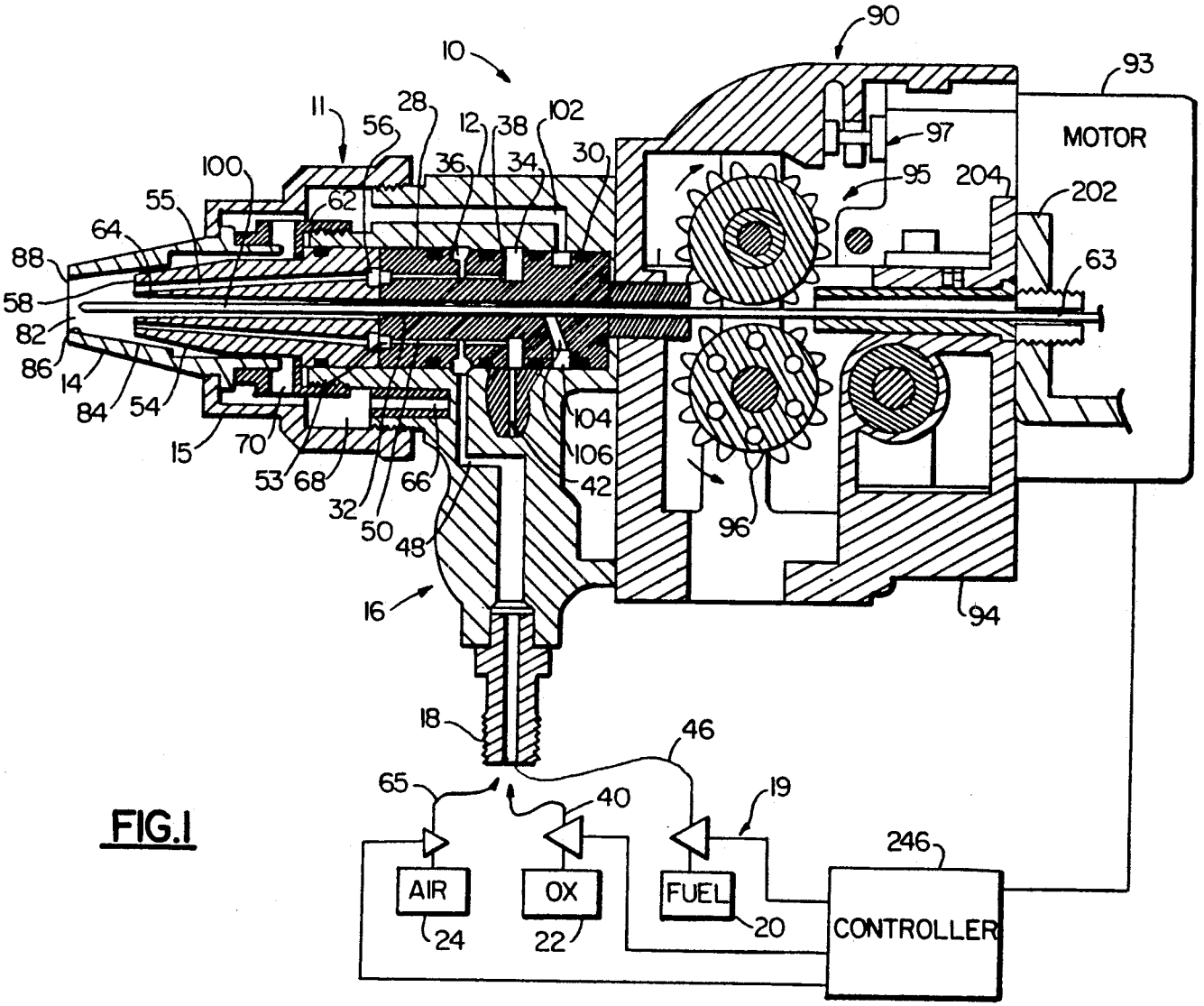
FIG. 1 is a vertical section of the wire thermal spray gun utilized for the invention.

A basic thermal spray apparatus for certain aspects of the present invention is illustrated in FIG. 1. A thermal spray gun 10 has a gas head 11 including a gas head body 12 with a gas cap 14 mounted with a retainer ring 15 thereon, and a channeling section 16 for fuel, oxygen and air. This section has a hose connection 18 for a fuel gas. Two other hose connections (not shown) for oxygen and air are spaced laterally from connector 18, above and below the plane for FIG. 1. The three connections are connected respectively via valves 19 and hoses to a fuel source 20, an oxygen source 22 and an air source 24. The valves control the flow of the respective gases from their connections into the gun.

A cylindrical siphon plug 28 is fitted in a corresponding bore in the gas head, and a plurality of O-rings 30 thereon maintain gas-tight seals. The siphon plug is provided with a central passage 32, and with an annular groove 34 and a further annular groove 36 with a plurality of inter-connecting passages 38 (two shown). Oxygen is passed by means of a hose 40 through its connection (not shown) and into a passage 42 (partially shown) from whence it flows into groove 34 and through passage 38.

A similar arrangement is provided to pass fuel gas from source 20 and a hose 46 through connection 18, and a passage 48 into groove 36, mix with the oxygen, and pass as a combustible mixture of the combustion gases (fuel and oxygen) through passages 50 aligned with passages 38 into an annular groove 53. Groove 53 is adjacent to the rear surface of a nozzle member 54 which is provided with an annular arrangement of orifices 55 leading to the nozzle face 58 at the forward end of the nozzle, fed by an annular channel 56 from groove 53. Orifices 55 exit at a circular location on face 58 coaxial with gas cap 14. The combustible mixture from groove 53 passes through channel 56 to produce an annular flow and is ignited at face 58 of nozzle 54. The annular arrangement of orifices 55 inject annular jets of the combustible mixture into the combustion chamber.

A nozzle nut 62 holds nozzle 54 and siphon plug 28 on gas head body 12. Further O-rings are seated conventionally between nozzle 54 and siphon plug 28 for gas tight seals. Burner nozzle 54 extends into gas cap 14 which extends forwardly from the nozzle. Nozzle member 54 is also provided with an axial bore 64 extending forwardly as a continuation of passage 32, for a spray wire 63 which is fed from the rear of gun 10. (As used herein and in the claims, "forward" or "forwardly" denotes toward the open or spraying end of the gun; "rear", "rearward" or "rearwardly" denotes the opposite.)

Air or other non-combustible pressurized gas is passed from source 24 and hose 65 through its connection (not shown), cylinder valve 26, and a passage 66 (partially shown) to a space 68 in the interior of retainer ring 15. Lateral openings 70 in nozzle nut 62 communicate space 68 with a cylindrical combustion chamber 82 in gas cap 14 so that the air may flow as a forward sheath from space 68 through these lateral openings 70, thence through an annular slot 84 between the forward surface of nozzle 54 and an inwardly facing cylindrical wall 86 defining combustion chamber 82, through chamber 82 as an annular forward flow, and out of the open end 88 in gas cap 14. Chamber 82 is bounded at its opposite, rearward end by face 58 of nozzle 54.

A rear body 94 contains a drive mechanism for wire 63. Such mechanism includes an electric motor 93 (or air turbine), with conventional gearing (not shown) driving a pair of rollers 95 which have a geared connector mechanism 96 and engage the wire. The gearing should include a mechanism 97 for disengaging the rollers from the wire, for example as disclosed in the aforementioned U.S. Pat. No. 3,148,818.

An annular space 100 between wire 63 and the forward wall of central passage 32, which also extend through nozzle 54, provides for an annular rearward sheath flow of gas, preferably air, about the wire extending from the nozzle. This rearward sheath of air is a conventional method of preventing backflow of hot gas along the wire and normally contributes to reducing a tendency of buildup of spray material on wall 86 in the aircap. The sheath air is conveniently tapped from the air supplied to space 68, via a duct 102 in gas head 12 to an annular groove 104 in the rear portion of siphon plug 28, and at least one orifice 106 into annular space 100 between wire 63 and siphon plug 28.

Figures 2, 2A:
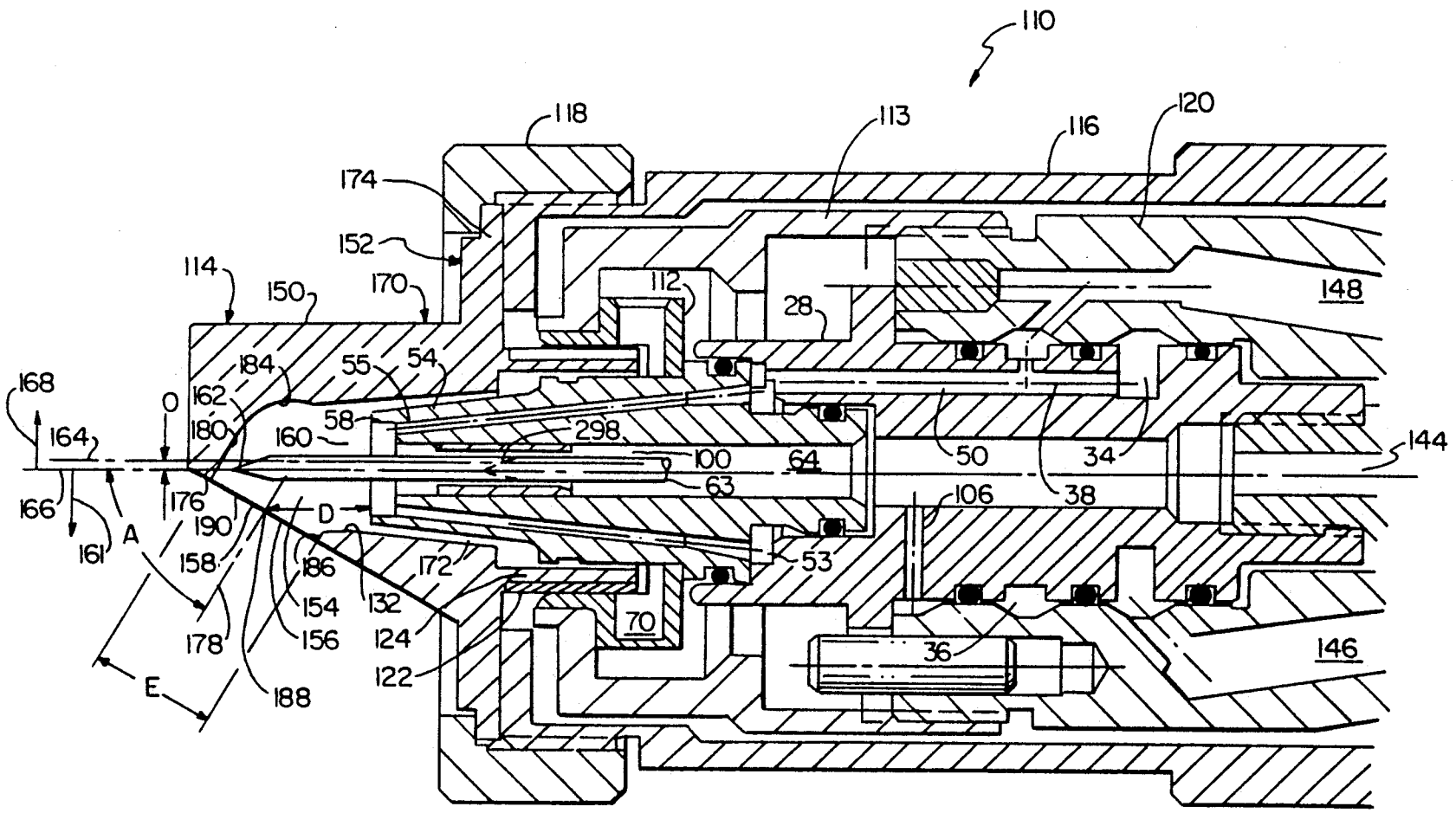
FIG. 2 is a longitudinal section of an extension for the thermal spray gun of FIG. 1 incorporating an angular gas cap of the invention.

FIG. 2 shows an extension 110 of a thermal spray gun incorporating an embodiment of the invention. Although such an extension is useful for powder thermal spraying, preferably the extension connects to a gun body of the type shown in FIG. 1, replacing the conventional nozzle/cap assembly. For some applications the extension may be rotated for spraying circumferentially in a bore hole. The siphon plug 28, nozzle 54 and some associated components are the same as for a conventional gun as described for FIG. 1. These are given the same numeral designations in FIG. 2, and the above descriptions are applicable. One change is a steel nozzle bushing 112 retained with a threaded member 113, replacing the nozzle unit, the bushing having the openings 70.

An annular gas cap 114 is attached to a tubular housing 116 with a threaded retainer ring 118 which provides a gas-tight seal joint. The housing extends rearwardly over member 113 and a tubular gas head 120 which connects into the gun body. The gas cap and forward end of the housing are mounted over the gas head by a forward bearing 122 which allows rotation of the gas cap/housing assembly on the gas head if such is desired in utilizing the extension. The bearing is advantageously a bronze bushing press fitted on a rearward protrusion 124 of the gas cap, and slidingly fitted into the bushing 112 of hardened steel that also acts as the nozzle retainer.

Figure 2B:
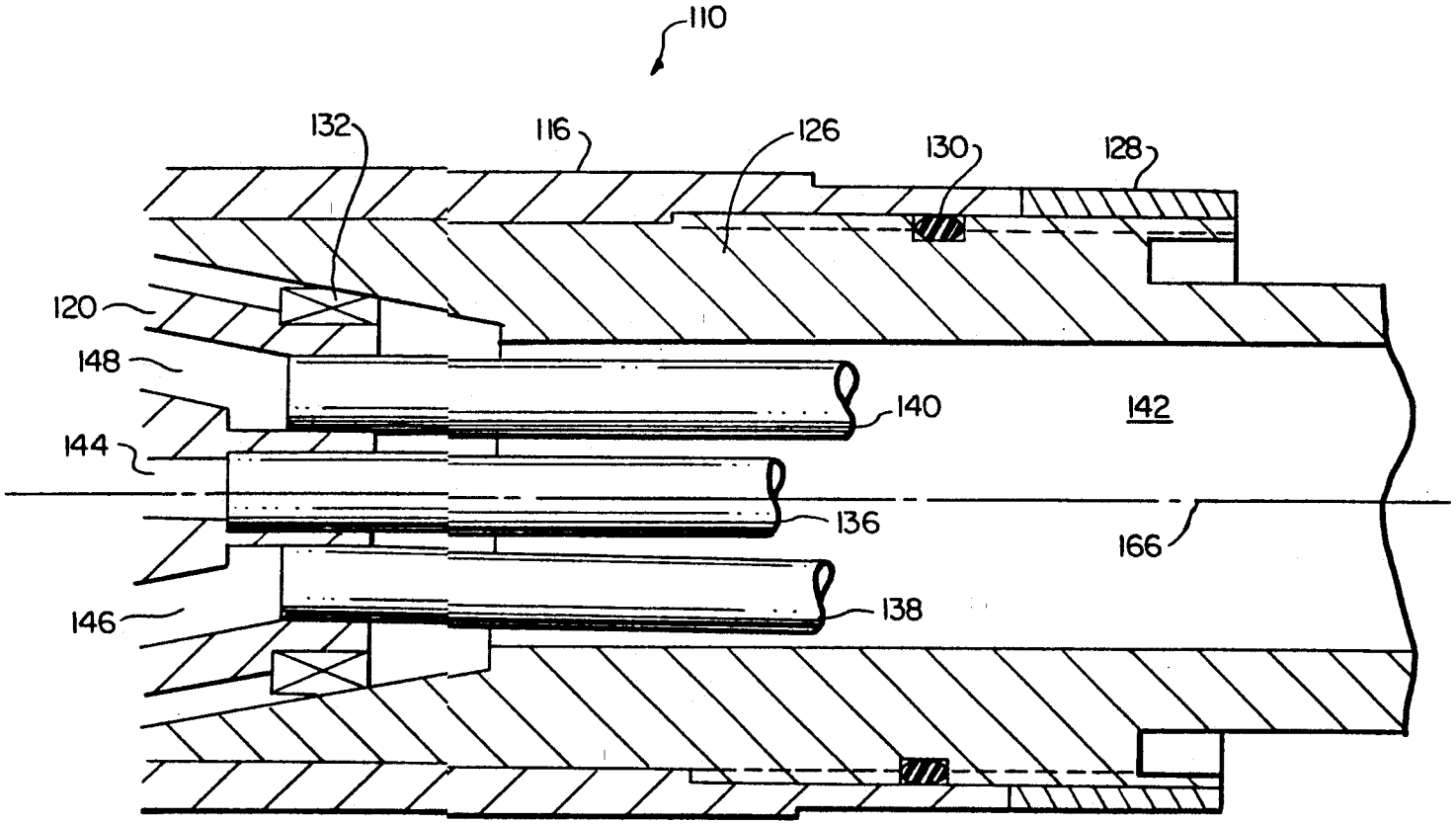

Rearwardly (FIG. 2*b*) the housing is threaded onto a rotatable tubular member 126 which effectively constitutes a rearward extension of the housing 116. A locking collar 128 is threaded on the tubular member abutting the housing to lock the housing in place on the member. An O-ring seal 130 is disposed between the housing and the member.

A rear bearing 132 such as a needle bearing supports the tubular member 126 and consequently the housing 116 rotatingly on the gas head 120, in accurate alignment with the main axis 134. The tubular member 126 extends back to the rear body of the gun where it is fitted into a hole in the body, for example with a double O-ring lubricated to effect a rotatably sliding seal.

The tubular member 126 contains a central pipe 136 for wire and a pair of rigid pipes 138,140 for conveying the combustion fuel and oxygen respectively, the pipes fitting into corresponding channels 144,146,148 in the gas head 120. The remaining space 142 in the elongated member conveys the atomizing air. The corresponding channels and space communicate with appropriate passages in the siphon plug 28 (FIG. 2*a*).

A conventional drive means (not shown) for rotating the housing on its axis may include gear teeth or a drive pulley on the perifery of the tubular member. An electrical motor mounted on the rear body is geared down with a similarly mounted gear box from which a drive shaft extends. A drive gear or pulley on the shaft engages the gear teeth or belt to rotate the assembly of the tubular member, housing and gas cap, for example at 200 rpm.

The angular gas cap 114 mounts over the nozzle 54. The angular cap comprises a cap body 150 and further comprises coupling means 152 extending therefrom for coupling the cap body on the extension 110 of the thermal spray gun. Although not shown, the angular cap may be utilized without an extension and so may be mounted directly over the nozzle of FIG. 1, replacing the conventional gas cap, if an elongated extension is not needed. The cap body (FIG. 2) has a passage 154 therethrough formed of a forward channel 156 with an open end 158, and an rearward channel 160. The rearward channel is adapted to extend from the nozzle 54. The forward channel extends from the rearward channel at an oblique angle A thereto so as to have a lateral directional component 161. Preferably, the oblique angle is between about 30° and 90°, for example 60°. The high pressure atomizing gas atomizes the melted wire tip 162 in the passage into a spray stream and propels the spray stream (not shown) at about the oblique angle.

The rearward channel has a channel axis 164 located so as to be parallel to the central axis 166 of the nozzle and, according to the invention, the channel axis is offset from the central axis in a direction 168 opposite the lateral directional component 161. The amount of offset O is preferably between about 1.5% and 20% of the exit diameter E at the open end of the gas cap; for example, for an exit diameter of 8.71 mm (0.343 in), the offset is between about 0.13 mm (0.005 in.) and 1.57 mm (0.062 in.). The coupling means 152 for the gas cap has a coupling axis coinciding with the central axis 166. Thus the channel axis is also offset from the coupling axis.

The cap body 150 has a rearward end 170 opposite the forward channel 156. The coupling means includes the tubular protrusion 124 extending rearwardly from the rearward end coaxially with the coupling axis so as to encompass the nozzle 54, leaving an annular passage 172 for conveying the pressurized air along the nozzle into the gas cap body. Preferably the rearward channel 160 diverges slightly conically toward the forward channel, to the same degree as a conventional gas cap.

The coupling means further includes a radial flange 174 extending outwardly from the rearward end, for engagement with the tubular housing by the retainer ring 118.

The cap body is bounded at the open end by a planar surface 176 perpendicular to the channel axis 178 of the forward channel 156, the channel axis being at the oblique angle A. Advantageously the forward channel is defined by a truncated cylindrical surface 180, preferably of uniform diameter equal to the exit diameter. The truncation is defined by the rearward channel wall 182 and a transition surface 184. The cylindrical surface 180 should have a shortest length 186 between the planar surface and the rearward channel between about 1.5% and 15% of the exit diameter E at the open end of the forward channel for example, for an exit diameter of 8.71 mm (0.343 in.), surface 180 is between about 0.13 mm (0.005 in) and 1.27 mm (0.05 in.). The transition surface should connect smoothly to the forward channel at the side opposite the lateral directional component. Conveniently the transition is effected by a ball milled spherical section, preferably with a radius equal to the forward channel diameter. The rearward channel should converge to a minimum diameter slightly less than the forward channel diameter.

The axis 178 of the forward channel has an intersection point 188 with a plane 190 extended across the planar surface, and the gas cap should be mountable on the gun so that this intersection point is spaced from the nozzle face 58 by a distance D between about 0.75 and 2.5 times the exit diameter E. For example, for an exit diameter of 8.71 mm (0.343 in.), distance D is between about 6.35 mm (0.25 in.) and 19 mm (0.75 in.).

According to a further aspect of the invention, to prevent mushrooming of the wire tip upon shutdown, and subsequent jamming or loading in the gas cap, the wire tip is retracted rapidly into a retracted position preferably within the nozzle upon shut down of the spraying operation. Such retraction should be useful under some conditions with a conventional, forward spraying aircap. Such conditions are where certain wire materials such as bronze are particularly susceptible to loading an air cap and/or the wire forms an objectionably large "mushroom" tip upon normal shut-down. However, retraction is particularly advantageous with an angular aircap, preferably an aircap of the type disclosed herein as in FIG. 2. The retracted tip is shown by broken lines at 298.

Figure 3:
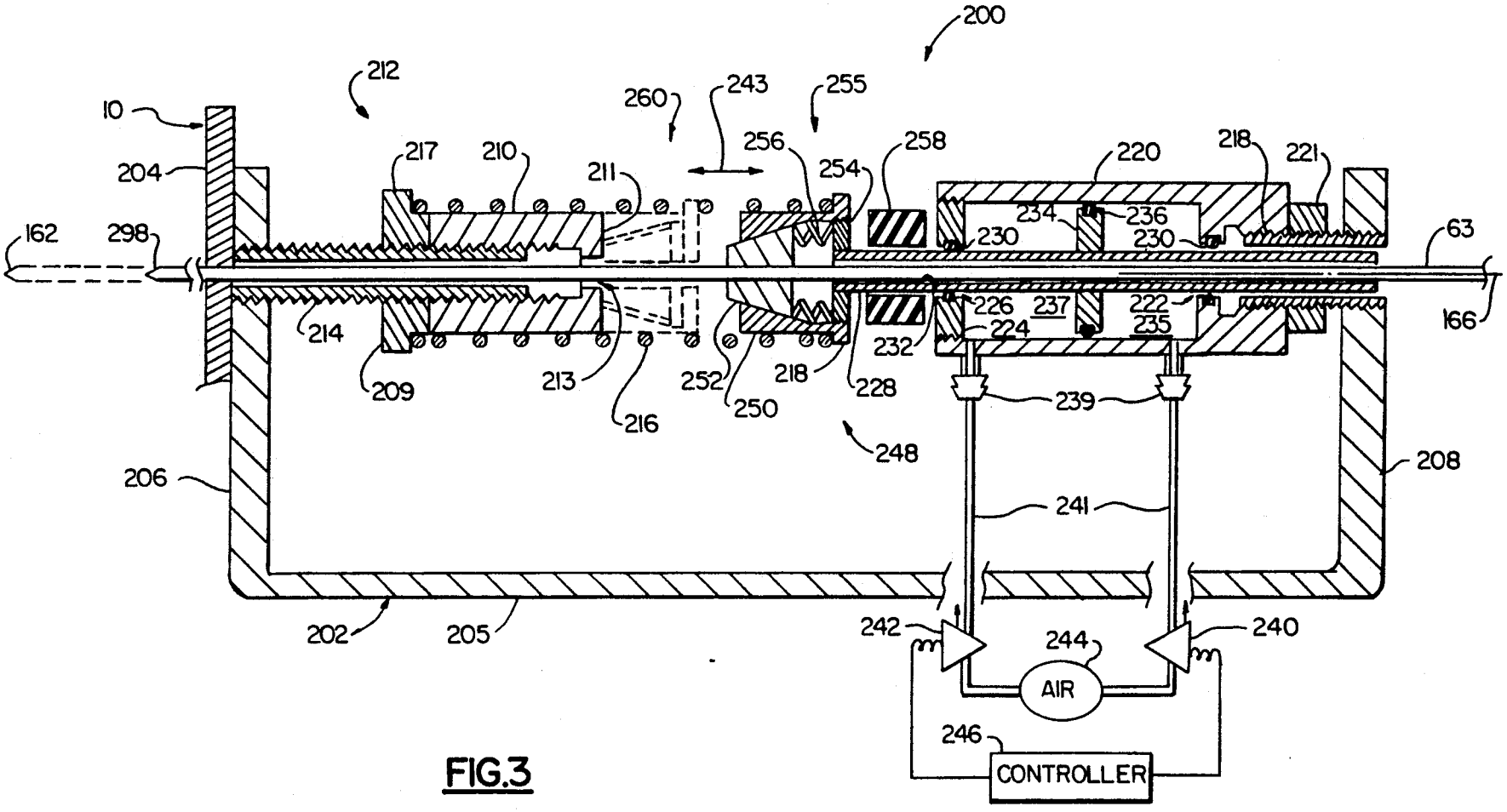
FIG. 3 is a longitudinal section of a wire retractor for a thermal spray gun according to an embodiment of the invention.

A positioning means in the form of an assembly 200 for retracting the wire upon shut-down of an thermal spraying operation is shown in FIG. 3. A support member such as a bracket 202 is mounted with bolts (not shown) on the rear plate 204 of the thermal spray gun 10 (See also FIG. 1). The bracket comprises a forward section 206 and a rear section, 208 both connected by a base section 205. Other components in the assembly are mounted in the bracket, so as to be connected to the gun with tandem passages aligned with the central gun axis for leading a thermal spray wire 63 into the gun.

A guide means 212 comprising a first threaded tube 214 extends rearwardly at the forward section 206. A retaining nut 209 is threaded onto the tube. A tubular member 210 is also threaded onto the tube, rearwardly of the nut, and is retained in a selected position by the nut tightened against it. The rear wall 211 of the guide means has an orifice 213 therein sized to loosely fit the wire and guide the wire into the gun. A main coil spring 216 may be fitted loosely over the tubular member 210 extending rearwardly therefrom. The forward end of the spring is positioned against the nut which either is larger than the member 210 or, as shown, has a flange 217 for positioning the spring.

A second threaded tube 218 extends forwardly from the rear section 208. A cylinder body 220 is threaded onto the second tube so as to extend forwardly therefrom, and is held in place with a jam nut 221. A rearward circular opening 222 is provided in the body, and a removable face plate 224 with a forward circular opening 226 is threaded into the forward end of the body. An elongated tube 228 is fitted slidingly through the openings with respective o-ring seals 230. The tube bore 232 is aligned with the gun so as to pass the spray wire through the guide means 212. A piston 234 is affixed to the tube and has an o-ring seal 236 slidingly engaging the cylinder wall, defining a rearward chamber 235 and a forward chamber 237 in the cylinder. The actuating motion 243 of the piston should be substantially parallel to the center axis 166 of the gun.

A pair of gas connectors 239 extend through the cylinder wall, one at each end of the cylinder. Gas hoses 241 lead from the connectors through respective valving 240,242 to a source of compressed gas 244, conveniently air. The valving is controlled to provide the gas to either chamber in the cylinder, and release gas from the other chamber, to selectively force the tube toward or away from the gun. The valving may consist of valves that also release the gas pressure downstream upon closing, or each set of valving may consist of a pair of valves in which one is opened to release the pressure in the cylinder upon closing of the valve to the gas supply. The valving is operated by a controller 246.

A chuck assembly 248, of the general type used with drills, includes a collet chuck 250 and a collet 252 mounted on the forward end of the elongated tube 228. The chuck is attached to the tube with an adaptor ring 254, is fitted into the main spring 216 and has a chuck flange 218 to compress the spring. The collet in the chuck protrudes from the chuck toward the rear wall 212 of the tubular member 210, and is held in a normally forward and closed on the wire by a strong spring system 256 compressed between the adaptor ring and the collet. Advantageously the spring system comprises a stack of Belleville springs. A thick elastomer (e.g. rubber) ring block 258 is fitted loosely on the elongated tube between the chuck assembly and the face plate of the cylinder body.

During thermal spraying compressed gas (air) from source 244 is maintained in the rearward chamber 235 of the cylinder, thereby urging the assembly with its collet 252 in a first position against the rear wall 212 of the tubular member which acts as a stroke stop for the chuck assembly. In this position the collet is open so as to allow free wire travel through the retracting means and the gun, so that the motor can pull the wire through.

Upon termination of the spraying process, the drive rollers are released conventionally from the wire, such as by the mechanism 97 (FIG. 1) of the aforementioned U.S. Pat. No. 3,148,818. Simultaneously with shut-off and release of the wire drive, the compressed air is reversed to release the pressure in the rearward chamber 235 and supply compressed air into the forward chamber 237. The main spring 216 and/or air cause the collet to be backed from the stroke stop, so that the Bellville springs urge the collet to engage the wire. The wire is then retracted rapidly for a short distance into a second position, preferably within the nozzle 54, as the piston, tube and chuck assembly are moved rearwardly. In operation the control means 248 regulates the valving so as to control the piston 234 alternatively between the first position or the second position.

With a sufficiently strong spring 216, the air supply and valving to the forward chamber 237 may be omitted with that chamber being open to air. In such case, when air pressure in the rear chamber 235 is released, the spring alone effects the retraction. Thus, for the first position, the control means 246 causes the linear actuator to urge the chuck assembly against the main spring into the first position and, for the second position, the control means releases the linear actuator such that the main spring urges the chuck assembly into the second position.

The ring block 258 cushions the assembly 248 at the end of the rearward stroke. In the present example the cylinder body 220 and the tubular member 210 each may be prepositioned longitudinally on the respective threaded tubes 218,209 and affixed in place by the jam nut 221 and the retaining nut 209. Once suitable positions are established, similar but permanent attachments may be substituted without such threadings. For example, the guide member simply may be a part of the forward section with a suitable bore and shoulder for a main spring (if any).

The cylinder, piston, tube and compressed air supply constitute a linear actuator for longitudingly positioning the chuck assembly. Such means may be provided by alternative methods such as a magnetic (e.g. solenoid) actuator or a linear stepper motor.

In a further alternative embodiment, the linear actuator is mounted offset from the central axis but has an actuating motion substantially parallel to the axis. In this aspect there is no need for the actuator to have a wire passage therethrough. Instead, the actuator is located to one side of, e.g. above, the wire and has a side arm connecting the actuator to the chuck assembly. All other components and operation are essentially the same as described with respect to FIG. 3.

As a further alternative for feeding and retracting, the motor 93 (FIG. 1) for driving the wire may simply be a quickly reacting reversible servo motor through drive rolls 95 maintained in permanent engagement with the wire (except for removing and replacing the wire). Such a servo motor, e.g. Model DXM-202 of Emerson Electric Motor Company is operable in a first mode to drive the wire forwardly and in a second mode to retract the wire. Advantageously the motor is controlled by computer program in the controller 246' which reverses the motor only for the transitory moment of retraction of the wire tip into the nozzle, and then stops the motor.

In any event the wire tip should be retracted sufficiently fast to substantially prevent mushrooming of the wire tip upon termination of the spraying process. The retraction should be within 0.5 seconds of termination of forward wire feed, for example 0.2 seconds.

In another aspect of the invention to further reduce buildup, particularly with the angular cap, it was discovered to be advantageous during startup of a spraying operation to momentarily advance the wire tip out of the nozzle at a very rapid speed greater than normal wire speed. Preferably the rapid speed is between 5% and 25% greater than normal. Normal gas flows (fuel, oxygen and pressurized gases) for the thermal spraying process are preset and flowing before this advance. These flows as well as normal wire speed are typically provided in instructions for the gun and/or material being sprayed. When the wire tip reaches its normal location in the gas cap passage, the wire feed speed is reduced to normal. The advance should occur at a speed of at least 5 cm/sec (2 in/sec), e.g. 50 cm/sec (20 in/sec) for a normal wire speed of 2.8 cm/sec (1.1 in/-sec). This sequence may be effected with a servo motor if such is also used for normal wire feed and the retraction.

Alternatively the initial rapid advance may be accomplished with a positioning means such as the same assembly 200 used for retracting. Thus, at such time when it is desirable to restart the wire feeding, the compressed air to the cylinder 220 is reversed, i.e. by releasing the pressure in the front chamber 237 and supply compressed air into the rearward chamber 235. The collet 252, which has continued to grip the wire in its retracted position, advances and pulls the wire until the collet strikes the wall 212 to be urged into the chuck 250 so as to thereby release the wire. This advance with the wire is effected with sufficient air pressure to chamber 235 to provide the desired rapid speed. Simultaneously with the wire reaching the forward position, the wire is re-engaged by the feed mechanism 97 being signaled by the controller, and is fed by the motor at its normal speed.

As an example of a thermal spray gun incorporating the present invention, a Metco Type 5K wire gun sold by The Perkin-Elmer Corporation, Westbury, N.Y. is modified as described herein. The gas cap is an angular cap or, for a simple embodiment with a retractor, an EC air cap, or alternatively a J air cap.

As an example of a angular gas cap of the invention, the oblique deflection angle is 60°, exit diameter is between 8.13 and 9.27 mm, the offset F is 0.38 mm, and distance D is 9 mm. The normal wire speed should be adjusted so that wire tip 134 being melted is located proximate open end 88.

The wire or rod should have conventional sizes and accuracy tolerances for thermal spray wires and thus, for example may vary in size between 6.4 mm and 0.8 mm (20 gauge). The wire or rod may be formed conventionally as by drawing, or may be formed by sintering together a powder, or by bonding together the powder by means of an organic binder or other suitable binder which disintegrates in the heat of the heating zone, thereby releasing the powder to be sprayed in finely divided form. Any conventional or desired thermal spray wire of heat fusible material may be utilized, generally metal although ceramic rod may be utilized.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. An angular gas cap for a nozzle of a wire thermal spray gun, the nozzle having a central axis, the gas cap comprising a cap body and coupling means extending therefrom for coupling the cap body onto the thermal spray gun so as to extend the gas cap forwardly from the nozzle, the cap body having a passage therethrough defining a combustion chamber such that a wire feeding on the central axis through the nozzle into the passage has a tip melted by an annular flame in the combustion chamber issuing from the nozzle, the cap body being receptive of a pressurized gas for atomizing the melted tip into a spray stream, the passage including a forward channel with an open end and a rearward channel adapted to extend from the nozzle, wherein the forward channel extends from the rearward channel at an oblique angle thereto so as to have a lateral directional component, the rearward channel has a channel axis, and the coupling means is such that the channel axis is parallel to the central axis and offset therefrom in a direction opposite the lateral directional component.

2. The gas cap according to claim 1 wherein the coupling means has a coupling axis offset from the channel axis so as to coincide with the central axis.

3. The gas cap according to claim 2 wherein the cap body has a rearward end opposite the open end, and the coupling means is disposed at the rearward end and comprises a tubular protrusion extending rearwardly from the rearward end so as to encompass the nozzle cooperatively to form an annular passage for conveying pressurized gas to the cap body.

4. The gas cap according to claim 3 wherein the coupling means further comprises a radial flange extending radially outwardly for engaging the gun.

5. The gas cap according to claim 1 wherein the forward channel has a forward axis at the oblique angle, and the cap body is bounded at the open end by a planar surface generally perpendicular to the forward axis.

6. The gas cap according to claim 5 wherein the forward channel is defined by a truncated cylindrical surface.

7. The gas cap according to claim 6 wherein the open end has an exit diameter, and the cylindrical surface has a shortest length between the planar surface and the rearward channel between about 1.5% and 15% of the exit diameter.

8. The gas cap according to claim 6 wherein the passage has a rounded transition surface between the forward channel and the rearward channel on a side opposite the lateral directional component.

9. The gas cap according to claim 5 wherein the nozzle terminates at a nozzle face, the forward axis has an intersection point with a plane extended across the planar surface, and the gas cap is mountable on the gun so that the intersection point is spaced from the nozzle face by a distance between about 0.75 and 2.5 times the exit diameter.

10. The gas cap according to claim 1 wherein the oblique angle is between about 30° and 90°.

11. An angular gas cap for a nozzle of a thermal spray gun, the gas cap comprising a cap body and coupling means extending therefrom for coupling the cap body onto the thermal spray gun, the cap body having a passage therethrough including a forward channel with an open end and a rearward channel adapted to extend from the nozzle, wherein the forward channel extends from the rearward channel at an oblique angle thereto so as to have a lateral directional component, the nozzle has a central axis, the rearward channel has a channel axis, and the coupling means is such that the channel axis is parallel to the central axis and offet therefrom in a direction opposite the lateral directional component, wherein the rearward channel converges conically toward the forward channel.

12. An angular gas cap for a nozzle of a thermal spray gun, the gas cap comprising a cap body and coupling means extending therefrom for coupling the cap body onto the thermal spray gun, the cap body having a passage therethrough including a forward channel with an open end and a rearward channel adapted to extend from the nozzle, wherein the forward channel extends from the rearward channel at an oblique angle thereto so as to have a lateral directional component, the nozzle has a central axis, the rearward channel has a channel axis, and the coupling means is such that the channel axis is parallel to the central axis and offet therefrom in a direction opposite the lateral directional component, wherein the open end has an exit diameter, and the offset is between about 1.5% and 20% of the exit diameter.

13. A thermal spray apparatus including a thermal spray gun, the gun comprising a gun body, a nozzle mounted on the gun body, an angular gas cap extending forwardly from the nozzle with a passage therethrough defining a combustion chamber, means for supplying fuel and oxidizing gases through the nozzle so as to effect an annular flame in the combustion chamber, drive means mounted on the gun body for feeding a wire forwardly through the nozzle on a central axis such that the wire has a tip melted by the annular flame, and means for providing pressurized gas into the angular gas cap for atomizing the melted tip into a spray stream, wherein the passage includes a forward channel with an open end and a rearward channel adapted to extend from the nozzle on a channel axis, the forward channel extends from the rearward channel at an oblique angle thereto so as to have a lateral directional component, and the channel axis is parallel to the central axis and offset therefrom in a direction opposite the lateral directional component.

14. The apparatus according to claim 13 wherein the apparatus further comprises positioning means disposed with respect to the gun for retracting the wire tip to a retracted position rearward of the combustion chamber immediately upon termination of feeding the wire.

15. The apparatus according to claim 14 wherein the retracted position is within the nozzle.

16. The apparatus according to claim 14 wherein the positioning means retracts the wire sufficiently fast upon termination of feeding the wire to prevent significant mushrooming of the wire tip.

17. The apparatus according to claim 14 wherein the positioning means includes advancing means for momentarily advancing the wire tip forwardly from the retracted position into the combustion chamber at a rapid speed greater than normal wire speed, upon startup of spraying.

18. A thermal spray apparatus comprising a thermal spray gun and a wire positioning means, the gun comprising a gun body, a nozzle mounted on the gun body, an angular cap extending forwardly from the nozzle to define a combustion chamber, means for supplying fuel and oxidizing gases through the nozzle so as to effect an annular flame in the combustion chamber, drive means mounted on the gun body for feeding a wire forwardly through the nozzle on a central axis such that the wire has a tip melted by the annular flame, and means for providing pressurized gas into the gas cap for atomizing the melted tip into a spray stream, wherein the positioning means is disposed with respect to the gun for retracting the wire tip to a retracted position within the nozzle rearward of the combustion chamber immediately upon stopping feeding of the wire, wherein the positioning means retracts the wire tip to the retracted position within 0.5 seconds of stopping feeding of the wire to prevent significant mushrooming of the wire tip.

19. The apparatus according to claim 18 wherein the positioning means includes advancing means for momentarily advancing the wire tip forwardly from the retracted position into the combustion chamber at a rapid speed greater than normal wire speed, upon startup of spraying.

20. The apparatus according to claim 18 wherein the drive means and the positioning means comprise a single motor operable in a first mode to feed the wire forwardly and in a second mode to retract the wire.

21. The apparatus according to claim 18 further including control means for maintaining flows of the fuel and oxidizing gases and the pressurized gas during retracting of the wire.

22. A thermal spray apparatus comprising a thermal spray gun and a wire positioning means, the gun comprising a gun body, a nozzle mounted on the gun body, a gas cap extending forwardly from the nozzle to define a combustion chamber, means for supplying fuel and oxidizing gases through the nozzle so as to effect an annular flame in the combustion chamber, drive means mounted on the gun body for feeding a wire forwardly through the nozzle on a central axis such that the wire has a tip melted by the annular flame, and means for providing pressurized gas into the gas cap for atomizing the melted tip into a spray stream, wherein the positioning means is disposed with respect to the gun for retracting the wire tip to a retracted position rearward of the combustion chamber immediately upon stopping feeding of the wire, the positioning means includes advancing means for momentarily advancing the wire tip forwardly from the retracted position into the combustion chamber at a rapid speed greater than normal wire speed, said momentarily advancing being upon startup of spraying, and the positioning means comprises gripping means separate from the drive means, the gripping means being for gripping the wire to retract and advance the wire.

23. A thermal spray apparatus comprising a thermal spray gun and a wire positioning means, the gun comprising a gun body, a nozzle mounted on the gun body, a gas cap extending forwardly from the nozzle to define a combustion chamber, means for supplying fuel and oxidizing gases through the nozzle so as to effect an annular flame in the combustion chamber, drive means mounted on the gun body for feeding a wire forwardly through the nozzle on a central axis such that the wire has a tip melted by the annular flame, and means for providing pressurized gas into the gas cap for atomizing the melted tip into a spray stream, wherein the positioning means is disposed with respect to the gun for retracting the wire tip to a retracted position rearward of the combustion chamber immediately upon stopping feeding of the wire, and the positioning means comprises gripping means separate from the drive means, for gripping the wire to retract the wire.

24. The apparatus according to claim 23 wherein the positioning means comprises:

a guide means connected to the gun in alignment therewith for guiding a spray wire into the gun, the guide means including a rearwardly facing guide wall with an orifice therein for the wire;

a linear actuator connected to the gun and having an actuating motion substantially parallel to the central axis;

a chuck assembly attached to the linear actuator so as to be longitudinally positionable by the actuating motion, the chuck assembly comprising a collet chuck, a collet disposed in the chuck so as to protrude from the chuck toward the guide wall, and spring means for urging the collet forwardly in the chuck so as to normally engage the wire; and control means for selectively controlling the linear actuator to a first position or a second position, the first position being such that the collet is urged against the guide wall so that the collet is disengaged from the wire, and the second position being such that the chuck assembly is retracted away from guide wall so that the spring means causes the collet to engage the wire;

whereby with the linear actuator in the first position, the wire is free to feed through the gun and, during a transition to the second position, the wire is engaged by the collet and retracted thereby.

25. The apparatus according to claim 24 wherein the linear actuator comprises a gas piston actuator, and the control means comprises gas supply means for selectively providing pressurized gas to the piston actuator.

26. The apparatus according to claim 24 further comprising a main spring compressed between the chuck assembly and the forward section, wherein for the first position the control means causes the linear actuator to urge the chuck assembly against the main spring into the first position, and for the second position the control means releases the linear actuator such that the main spring urges the chuck assembly toward the second position.

27. The apparatus according to claim 24 wherein, during a further transition from the second position to the first position upon startup of spraying, the positioning means is such as to advance the wire tip forwardly from the retracted position into the combustion chamber at a rapid speed greater than normal wire speed.

28. A method for thermal spraying with reduced tendency for buildup of spray material in an angular gas cap of a thermal spray gun, the gun including a gun body, a nozzle mounted on the gun body, and an angular gas cap extending forwardly from the nozzle with a passage therethrough defining a combustion chamber, the passage including a forward channel with an open end and a rearward channel adapted to extend from the nozzle on a channel axis, and the forward channel extending from the rearward channel at an oblique angle thereto so as to have a lateral directional component, wherein the method comprises supplying fuel and oxidizing gases through the nozzle so as to effect an annular flame in the combustion chamber, feeding a wire forwardly through the nozzle on a central axis parallel to the channel axis and offset therefrom in a direction coinciding with the lateral directional component such that the wire has a tip melted by the annular flame, and providing pressurized gas into the angular gas cap so as to atomize the melted tip into a spray stream propelled generally at the oblique angle.

29. The method according to claim 28 further comprising stopping feeding of the wire, and retracting the wire tip to a retracted position rearward of the combustion chamber immediately upon stopping feeding.

30. The method according to claim 29 wherein the retracted position is within the nozzle.

31. The method according to claim 30 wherein the step of retracting comprises retracting the wire sufficiently fast upon stopping feeding to prevent significant mushrooming of the wire tip.

32. The method according to claim 29 further comprising momentarily advancing the wire tip forwardly from the retracted position into the combustion chamber at a rapid speed greater than normal wire speed, upon startup of spraying.

33. A method for thermal spraying with reduced buildup of spray material in a gas cap of a thermal spray gun, the gun including a gun body, a nozzle mounted on the gun body, and a gas cap extending forwardly from nozzle so as to define a combustion chamber, wherein the method comprises thermal spraying by supplying fuel and oxidizing gases through the nozzle so as to effect an annular flame issuing from the nozzle, feeding a wire forwardly through the nozzle such that the wire has a tip melted by the annular flame, and providing pressurized gas into the gas cap so as to atomize the melted tip into a spray stream, and terminating the thermal spraying by stopping feeding of the wire, and retracting the wire tip to a retracted position within the nozzle rearward of the combustion chamber immediately upon stopping feeding, wherein the step of retracting the wire tip to the retracted position is effected within 0.5 seconds of stopping feeding to prevent significant mushrooming of the wire tip.

34. The method according to claim 33 further comprising momentarily advancing the wire forwardly from the retracted position into the combustion chamber at a rapid speed greater than normal wire speed, upon startup of spraying.

35. The method according to claim 34 further comprising establishing normal flows of the fuel gas, the oxidizing gas and the pressurized gas prior to the step of momentarily advancing.

36. The method according to claim 33 wherein the steps of feeding and retracting comprise operating a single motor in a first mode to feed the wire forwardly and in a second mode to retract the wire.

37. The method according to claim 33 further including maintaining flows of the fuel and oxidizing gases and the pressurized gas during retracting of the wire.

38. A method for commencing thermal spraying with reduced buildup of spray material in a gas cap of a thermal spray gun, the gun including a gun body, a nozzle mounted on the gun body, and a gas cap extending forwardly from the nozzle so as to define a combustion chamber, wherein the method comprises thermal spraying by supplying fuel and oxidizing gases through the nozzle so as to effect an annular flame issuing from the nozzle, feeding a wire forwardly through the nozzle such that the wire has a tip melted by the annular flame, and providing pressurized gas into the gas cap so as to atomize the melted tip into a spray stream, and terminating the thermal spraying by stopping feeding of the wire, and retracting the wire tip to a retracted position rearward of the combustion chamber immediately upon stopping feeding, wherein the step of feeding is effected with a drive means for feeding the wire forwardly, and the retracting comprises gripping the wire separately from the drive means to retract the wire.

* * * * *

UNITED STATES PATENT AND TRADEMARK OFFICE

CERTIFICATE OF CORRECTION

PATENT NO. : 5,275,336

DATED : January 4, 1994

INVENTOR(S) : Robert J. Stasi, et al

It is certified that error appears in the above-indentified patent and that said Letters Patent is hereby corrected as shown below:

In column 14, line 36, change "30" to --29--.

In column 15, line 12, delete "commencing".

Signed and Sealed this

Sixth Day of September, 1994

*Attest:*

Bruce Lehman

BRUCE LEHMAN

*Attesting Officer*

*Commissioner of Patents and Trademarks*